US005544029A

United States Patent [19]

Cunningham

[11] Patent Number: 5,544,029

[45] Date of Patent: Aug. 6, 1996

[54] LIGHTING FIXTURE FOR THEATER, TELEVISION AND ARCHITECTURAL APPLICATIONS

[76] Inventor: David W. Cunningham, 8442 Hollywood Blvd., Los Angeles, Calif. 90069

[21] Appl. No.: 151,724

[22] Filed: Nov. 12, 1993

[51] Int. Cl.[6] ..... F21V 7/20

[52] U.S. Cl. ..... 362/273; 362/294; 362/268; 362/310; 362/345; 362/328; 362/338; 362/351; 362/308; 313/113

[58] Field of Search ..... 362/321, 280, 362/293, 282, 334, 346, 310, 345, 373, 311, 294, 281, 268, 305, 340, 304, 337, 336, 329, 309, 328, 333, 296, 32, 297; 313/113, 112

[56] References Cited

U.S. PATENT DOCUMENTS

| | | | |
|---|---|---|---|
| 3,455,622 | 7/1969 | Cooper | 362/293 X |
| 3,842,253 | 10/1974 | Walker et al. | 362/293 X |
| 3,883,733 | 5/1975 | Nagel | 362/334 |
| 3,930,149 | 12/1975 | French | 362/293 X |
| 3,979,160 | 9/1976 | Anderson et al. | 353/63 |
| 4,152,052 | 5/1979 | Lessman | 352/107 |
| 4,240,133 | 12/1980 | Haina et al. | 362/293 |
| 4,298,920 | 11/1981 | Gluck et al. | 362/293 X |
| 4,482,942 | 11/1984 | Blaisdell et al. | 362/293 |
| 4,517,630 | 5/1985 | Dieffenbach et al. | 362/268 |
| 4,519,021 | 5/1985 | Oram | 362/277 |
| 4,604,680 | 8/1986 | Levin et al. | 362/293 |
| 4,704,660 | 11/1987 | Robbins | 362/293 X |
| 4,837,668 | 6/1989 | Koehler | 362/804 X |
| 4,890,208 | 12/1989 | Izenour | 362/293 X |
| 4,911,166 | 3/1990 | Leighton et al. | 362/106 |
| 5,014,166 | 5/1991 | Draper et al. | 362/61 |
| 5,143,445 | 9/1992 | Bateman et al. | 362/293 |
| 5,160,192 | 11/1992 | Sugawara | 362/16 |
| 5,177,396 | 1/1993 | Gielen et al. | 362/293 X |
| 5,255,163 | 10/1993 | Neumann | 362/293 X |
| 5,282,121 | 1/1994 | Bornhorst et al. | 362/293 X |

*Primary Examiner*—Denise L. Gromada
*Assistant Examiner*—Thomas M. Sember
*Attorney, Agent, or Firm*—Pretty, Schroeder, Brueggemann & Clark

[57] ABSTRACT

An improved lighting fixture for projecting a high-intensity beam of light that is imaged at a distant location, with reduced manufacturing cost and with reduced weight, but greater efficiency. Various structures are disclosed for eliminating infrared light from the projected beam, whereby the fixture's lens can advantageously be formed of a suitable plastic material and be configured as an aspheric fresnel lens or a stepped aspheric lens.

19 Claims, 5 Drawing Sheets

LIGHTING FIXTURE FOR THEATER, TELEVISION AND ARCHITECTURAL APPLICATIONS

BACKGROUND OF THE INVENTION

This invention relates generally to lighting fixtures and, more particularly, to lighting fixtures configured to image a high-intensity beam of light at a distant location.

Lighting fixtures of this particular kind are commonly used in theater, television and architectural lighting applications. Such fixtures typically include an ellipsoidal or near-ellipsoidal reflector with a single lamp located generally coincident with the reflector's longitudinal axis. The reflector defines two focal regions, and the lamp is positioned generally with its filaments located at or near a first of those two focal regions, such that light emitted from the filaments is reflected by the reflector generally toward the second focal region. A gate is located at that second focal region, and shutters, patterns and the like can be used at the gate for shaping the projected beam of light. A lens located beyond the gate aperture images light passing through the aperture at a distant location. An example of a lighting fixture of this particular kind is set forth in U.S. Pat. No. 5,345,371, issued Sep. 6, 1994 and entitled "Lighting Fixture."

Lighting fixtures of the kind described above typically include projecting lenses formed of glass, with spherical and/or aspherical surfaces. Aspheric glass lens are considered expensive, especially in the case of fixtures that provide narrow beam widths, which require the lenses to have diameters as large as 12 inches. Use of the spherical lens, of course, leads to certain aberrations that detract from the quality of the projected image.

Another drawback to the use of glass lens in such fixtures is that the glass is considered to introduce excessive weight to the fixture. In the case of fixtures that project beams of narrow beam width, this excessive weight can introduce an imbalance in the fixture, which can cause slippage or can require a complicated support mechanism.

It should therefore be appreciated that there is a continuing need for a lighting fixture of this kind that is configured to image a high-intensity beam of light at a distant location with reduced manufacturing expense and with reduced weight. The present invention fulfills this need.

SUMMARY OF THE INVENTION

The present invention is embodied in a lighting fixture incorporating a substantially ellipsoidal reflector, a lamp, and a lens for imaging a beam of light at a distant location, with substantially reduced manufacturing expense and with substantially reduced weight. The reflector has a base at one end and a mouth at the other end, and it defines a first focal region adjacent its base end and a second focal region beyond its mouth. The lamp, which typically is incandescent and includes one or more filaments emitting both visible and infrared light, is supported with the filaments located substantially coincident with the reflector's first focal region, such that light emitted by the filaments is reflected by the reflector toward the second focal region. A gate aperture is located substantially at the second focal region, and the lens images at the distant location the light passing through an aperture in the gate. The lighting fixture further includes dichroic means, interposed between the lens and the one or more filaments of the lamp, for removing from the light that reaches the lens a sufficient portion of the emitted infrared light to enable the lens to be formed of a plastic material, without overheating. The resulting apparatus can be manufactured with substantially reduced expense, and also with substantially reduced weight, thereby enhancing the apparatus' mechanical balance and facilitating its convenient orientation at any desired angle.

In a more detailed feature of the invention, the plastic lens is configured either as a flat or curved aspheric fresnel lens. When the lighting fixture is configured to project a beam of relatively narrow beam width, a flat fresnel lens can be used. In such cases, the fresnel lens is located relatively far from the gate aperture, and it can be formed of acrylic. When greater beam widths are desired, a curved fresnel lens, also called a stepped aspheric lens, must be used. In such cases the lens ordinarily is moved relatively closer to the gate aperture, so a plastic having a higher heat tolerance, e.g., polycarbonate, ordinarily must be used.

The dichroic means can take any of several different forms. In particular, it can constitute an infrared-reflective coating on a glass bulb of the lamp, or it can constitute an infrared-transmissive or infrared-absorptive coating on the ellipsoidal reflector. The dichroic means alternatively can constitute an infrared-reflective or an infrared-absorptive glass plate located between the mouth of the reflector and the plastic lens. Ideally, this plate is located at the site of the gate aperture, where its cross-sectional size can be minimized. Finally, the dichroic means can constitute an infrared-reflective coating on the plastic lens, itself.

In a separate, independent feature of the invention, the ellipsoidal reflector can be configured in two parts, including an inner portion adjacent its base and an outer portion adjacent its mouth, with the dichroic means constituting a thin-film coating only on the inner portion. This inner portion of the. reflector receives significantly more of the emitted light than does the outer portion. Accordingly, coating this portion of the reflector has the greatest effect in eliminating infrared light from the projected beam.

Other features and advantages of the present invention should become apparent from the following description of the preferred embodiments, taken in conjunction with the accompanying drawings, which illustrate, by way of example, the principles of the invention.

DESCRIPTION OF THE PREFERRED EMBODIMENTS

Figure 1:
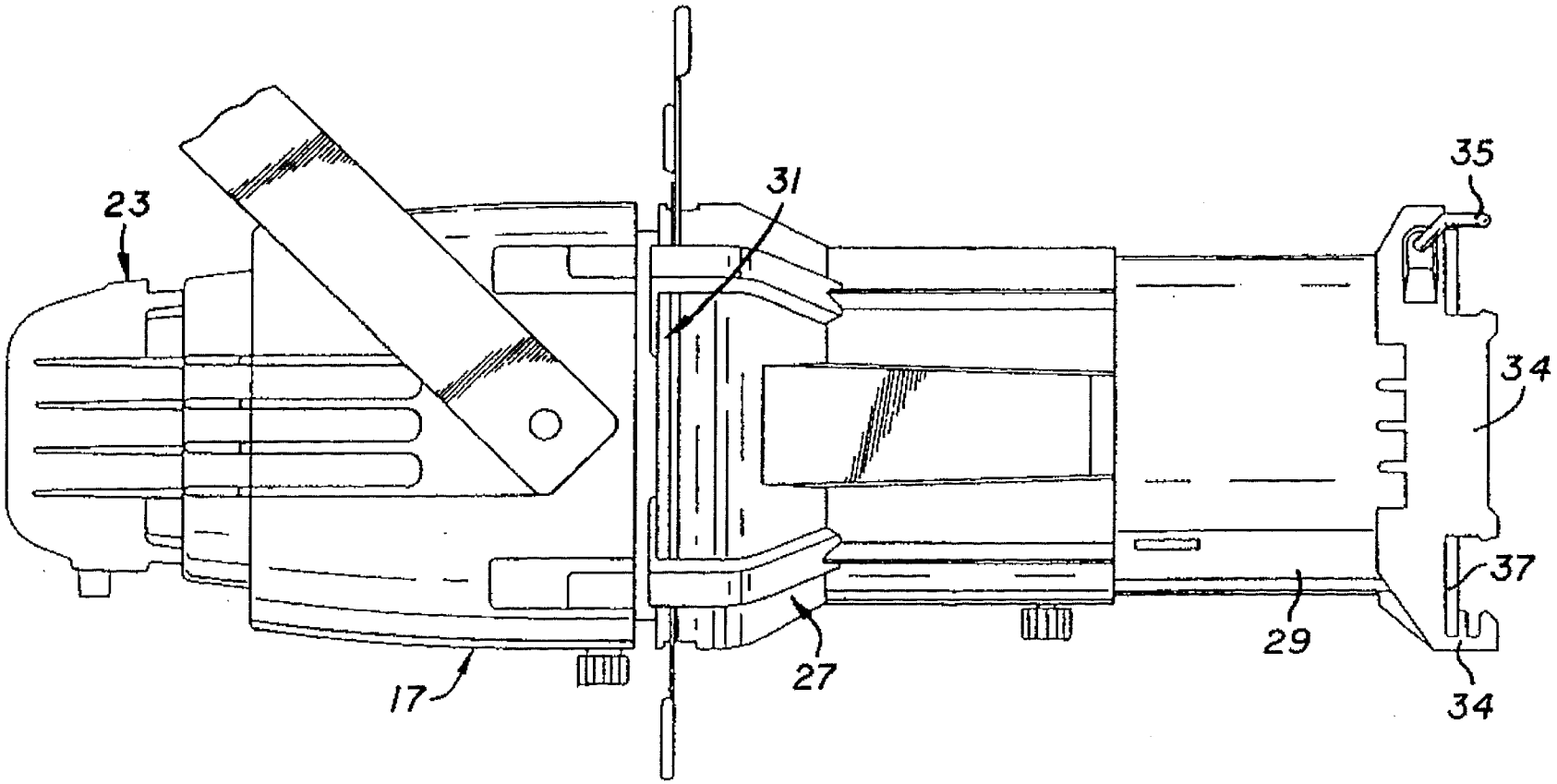
FIG. 1 is a side, elevational view of a lighting fixture embodying the present invention.
Figure 2:
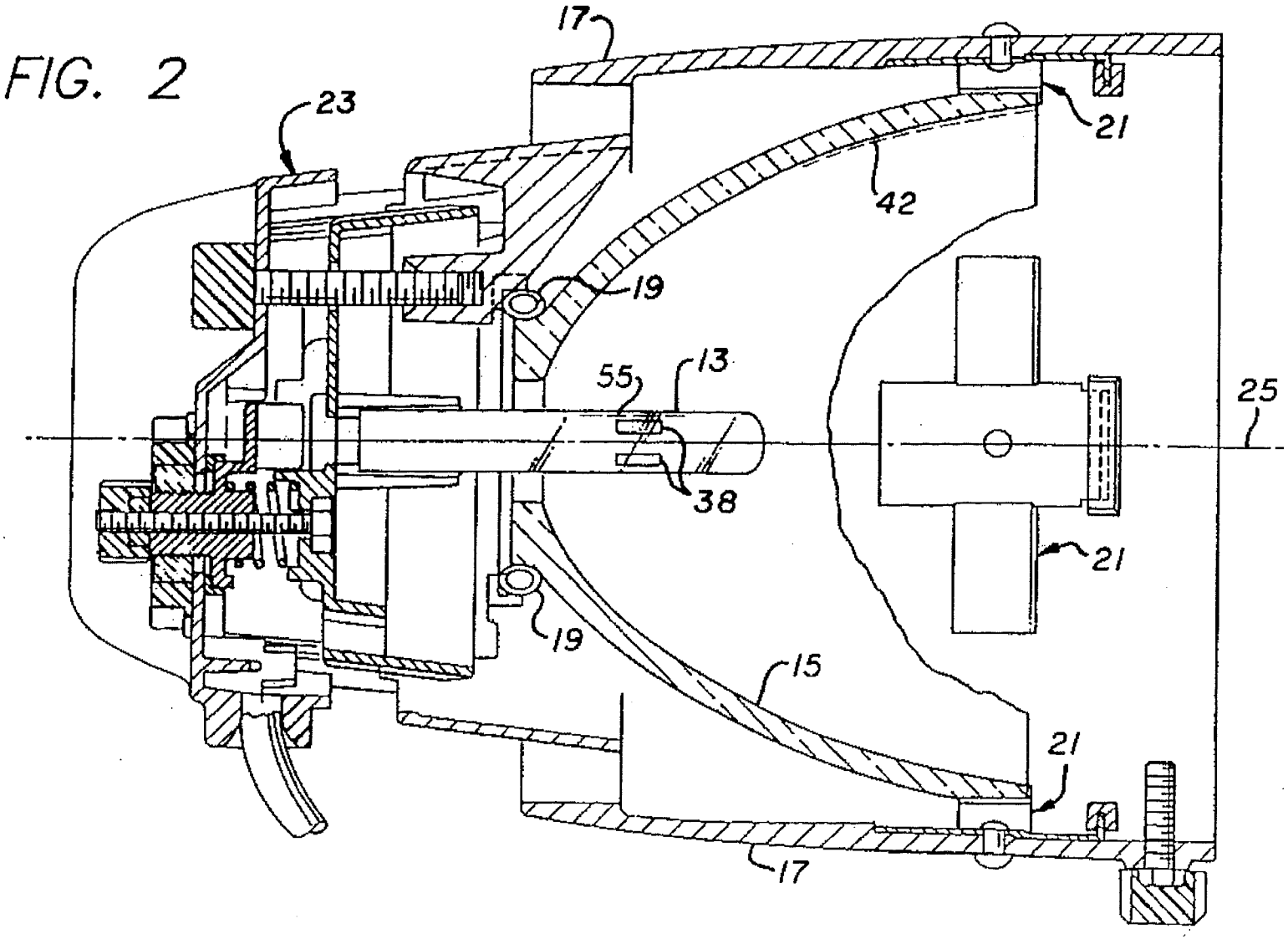
FIG. 2 is a side, sectional view of the rear portion of the lighting fixture of FIG. 1, shown with a lamp positioned with its filaments approximately coincident with one focal region of a near-ellipsoidal reflector.

With reference now to the drawings, and particularly to FIGS. 1 and 2, there is shown a lighting fixture 11 for use in combination with a lamp 13 in projecting an intense beam of light for imaging at a distant location. The lighting fixture is particularly adapted for use in theater, television and architectural lighting applications. The fixture includes a near-ellipsoidal reflector 15 located within a generally cylindrical rear housing 17. The reflector is secured to the housing at the reflector's base by an assembly that includes a coil spring 19 and at the reflector's mouth by four spring clips 21 positioned uniformly around the housing's inner periphery. A lamp receptacle or burner assembly generally designated by the reference numeral 23 is secured to the rear of the housing and supports the lamp 13 in a selected coaxial position within the reflector. In particular, the lamp is positioned with its central longitudinal axis substantially coincident with a central longitudinal axis 25 of the reflector. One suitable lamp for use in the lighting fixture of the invention is disclosed in U.S. Pat. No. 5,268,613, issued Dec. 7, 1993 and entitled "Incandescent Illumination System."

A generally cylindrical front barrel 27 and a lens tube 29 are secured to the forward end of the rear housing 17. The front barrel carries at its rearward end a gate assembly 31, and the lens tube carries a lens at one of several factory-selected locations along its length. The lens tube further includes guides 34 and a pivotable retainer 35 for carrying one or more colored media 36 in a media frame 37 at its forward end. Light emitted by filaments 38 of the lamp 13 is reflected by the reflector 15 through the gate assembly to the lens, which forms a beam that is projected through the media and away from the fixture 11. The different lenses and factory-selected lens positions allow for selection of the projected beam's field angle, typically ranging from as little as 5° to as high as 50°.

Figure 3:
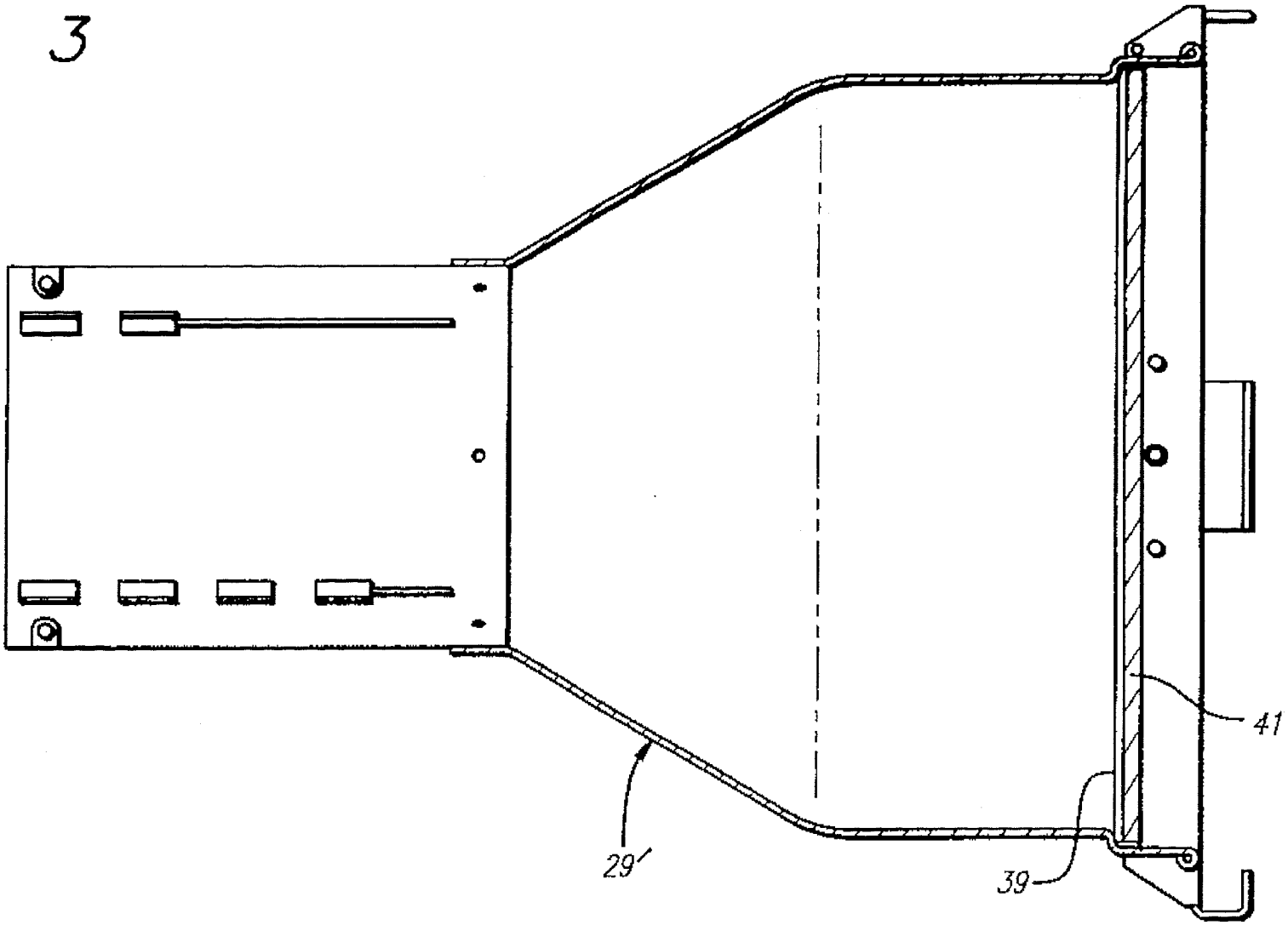
FIG. 3 is a side, sectional view of a modified, narrow field angle lens tube that may be substituted for the lens tube of the lighting fixture of FIG. 1.
Figure 6A:
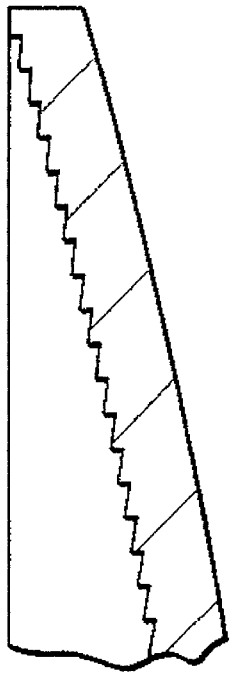
FIG. 6 is a cross-sectional view of a stepped aspheric lens suitable for use in the lighting fixture of FIG. 1.

FIG. 3 is a cross-sectional view of a lens tube 29' that provides a 10° field angle. It carries a thin, flat fresnel lens 39 at its outer end, with a transparent glass plate 41 located adjacent to the lens, to protect it from abrasion. This 10° lens tube is substantially larger in size than the wider-angle lens tube 29 depicted in FIG. 1, and it may be substituted for the lens tube 29.

The near-ellipsoidal reflector 15 is configured such that, by positioning the lamp 13 with its filaments 38 substantially coincident with one general focal region of the reflector, substantially all points on the reflector reflect emitted light through an aperture of the gate assembly 31 toward the lens 39. The gate aperture is located approximately at a second general focal region of the reflector. Each point or elemental area on the reflector produces at the gate assembly an image of the lamp filaments, as those filaments appear from that point on the reflector. The filament image is magnified by a factor corresponding to the ratio of the distance from the point on the reflector to the gate assembly divided by the distance from the point on the reflector to the filaments.

The filament images produced at the gate assembly 31 by the entire collection of points on the reflector 15 combine to reinforce each other and form a composite image. The lens 39 then functions to project this very same image toward a distant location, such as a theater stage. This is achieved by selectively positioning the lens forward of the gate by a distance corresponding generally to the lens' focal length, for a particular throw distance.

The composite image produced at the gate assembly 31, and thus imaged by the lens 39 at a distant location, generally can have an undesired non-uniform intensity distribution. Localized regions of high intensity, or hot spots, can occur wherever the filament images produced by elemental areas on the reflector 15 reinforce each other. This undesirable characteristic is minimized, and a desired light intensity distribution is achieved, by configuring the reflector 15 to be faceted in a circumferential direction. Each facet is substantially flat in a circumferential direction, but follows a generally elliptical curve in a radial direction. This faceting is disclosed in greater detail in U.S. Pat. No. 5,345,371, issued Sep. 6, 1994 and entitled "Lighting Fixture."

The effect of each facet is to blur the image of the lamp filaments formed at the gate assembly 31. Because the facets are arranged only circumferentially, this blurring occurs only in directions generally perpendicular to the facet's radial orientation. This has the effect of blurring the regions of high light intensity, but keeping substantially all of the light within the limits of the gate and lens. A substantially circumferentially uniform light intensity across the gate aperture thereby is provided, with minimal wastage of light missing the gate aperture and the lens 39.

The filaments 38 of the lamp 13 emit light in both visible and infrared wavelengths. Infrared light included in the projected beam would unduly heat the area on which the beam is imaged, which in the case of theater, television and some architectural lighting can lead to substantial discomfort. The lighting fixture therefore is configured such that only a small proportion of the infrared light emitted by lamp filaments is incorporated into the projected beam. This infrared light elimination is achieved by several alternative structures.

In one embodiment, the elimination of infrared light from the projected beam is achieved by applying a special thin-film coating to the near-ellipsoidal reflector 15. This coating is depicted schematically in FIG. 2 and identified by the reference numeral 42. The coating is configured to reflect a very high proportion of visible light, while transmitting a very high proportion of infrared light. The reflector can be formed of molded borosilicate glass, and the thin-film coating can include 15 or more alternating layers of silicon dioxide and titanium oxide or tantalum oxide. Each such layer has a thickness substantially less than the wavelength of visible light. Alternatively, the reflector 15 can constitute an aluminized or polished metal substrate, and the coating can be adapted to absorb the undesired infrared light. Those skilled in the art will know of numerous suitable materials for use as the coating material.

Figure 4:
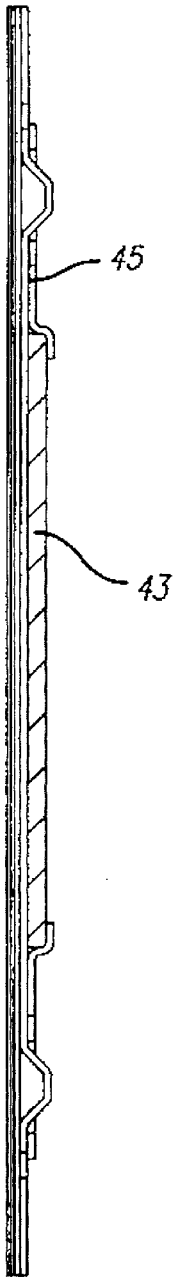
FIG. 4 is a sectional view of a glass plate assembly that can be inserted into the lighting fixture of FIG. 1, for removing infrared light from the projected beam.

FIG. 4 depicts an alternative structure for eliminating infrared light from the projected beam. It constitutes a glass substrate 43 mounted to a support plate 45 that forms part of the gate assembly 31. The glass substrate either is coated with an infrared-reflective coating or incorporates an infrared-absorptive material such as iron oxide, which removes a substantial portion of the incident infrared light, but transmits substantially all of the incident visible light. By placing the coated glass substrate at the site of the gate assembly, where the cross-sectional size of the light is a minimum, the glass substrate's size can be minimized. This provides substantial manufacturing cost savings. In addition, placing the glass substrate in advance of the shutters (not shown) associated with the gate assembly reduces the amount of energy incident on the shutters, thereby minimizing the risk of damage.

In the case of a glass substrate 43 having a coating that is infrared-reflective, the incident infrared light is reflected back toward the lamp 13 and the reflector 15, where it is either absorbed or reflected again. Eventually, a large proportion of the multiple-reflected infrared light impinges on the support plate 45 or other portion of the gate assembly 31, where it is absorbed and dissipated as heat. In the case of a glass substrate 43 that incorporates infrared-absorptive material, on the other hand, the incident infrared light is absorbed and then transferred by convection to the surrounding air.

Figure 5:
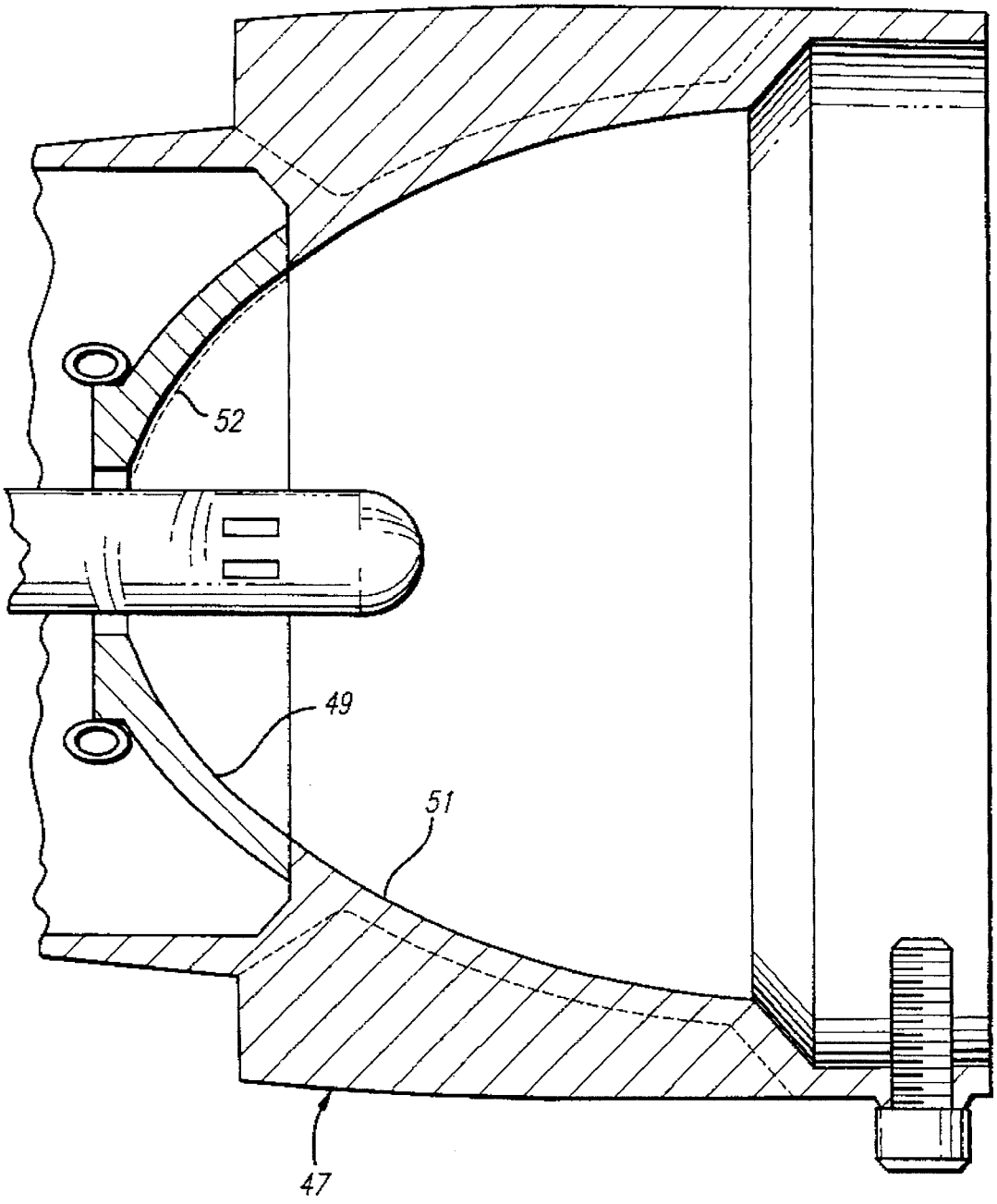
FIG. 5 is cross-sectional view of a modified two-part near-ellipsoidal reflector suitable for use in the lighting fixture apparatus of FIG. 1.

In another embodiment, depicted in FIG. 5, the structure for eliminating infrared light from the projected beam is provided by a specially-coated, two-part reflector 47, which can be substituted for the reflector 15 of the earlier embodiments. This two-part reflector includes an inner portion 49 defining the reflector's base end and an outer portion 51 defining the reflector's mouth. In this embodiment, a coating for removing infrared light is provided only on the inner reflector's portion 49. This coating is depicted schematically in FIG. 5 and identified by the reference numeral 52. The coated reflector portion can take the form of a thin-film, infrared-transmissive coating on a glass substrate or an infrared-absorptive coating on an aluminized or polished metal substrate, as described above.

Constructing the reflector 47 in two parts, and specially coating only the smaller of the two parts, can substantially reduce the reflector's manufacturing cost, without significantly detracting from the lighting fixture's overall performance. The inner portion 49 of the two-part reflector, being closer to the lamp filaments 38 than is the outer portion 51, receives proportionately more of the emitted light. Consequently, coating this portion of the reflector has greatest effect in eliminating infrared light from the projected beam.

In addition, the reflector's inner portion 49 provides greater magnification of the lamp filaments 38 at the site of the gate assembly 31. Because of this increased magnification, a greater portion of the light reflected from this inner portion 49 must be directed toward the middle portion of the gate assembly. With lower magnification, the light redirected from the outer portion 51 typically is directed toward peripheral portions of the gate aperture. A more uniform intensity distribution across the gate aperture thereby is provided. Coating only the reflector's inner portion is considered effective in eliminating the most harmful portion of the undesired infrared light.

Yet another structure for eliminating infrared light from the projected beam includes an infrared-reflective coating on the envelope portion of the lamp 13, itself. This coating is depicted schematically in FIG. 2 and identified by the reference numeral 55. The technology for coated lamps of this kind is well developed, but such lamps have not previously been used in lighting fixtures of this kind. It will be appreciated that, despite the coating, a certain amount of infrared light nevertheless is eventually emitted by the lamp. However, because a large proportion of that emitted infrared light escapes only after it has been reflected one or more times by the infrared-reflective coating, its effect will be as though it had been emitted by a source having a size comparable to that of the envelope. As such, a large proportion of that light will thus originate from points that are spaced substantially from the first focal region of the reflector 15, such that it will be reflected by the reflector in directions other than toward the second focal region. Consequently, a large proportion of the infrared light emitted by the lamp will overfill the gate aperture and not become part of the projected beam. Instead, it will impinge on the gate assembly's support structure, where it is absorbed and dissipated as heat.

Yet another structure for eliminating infrared light from the projected beam is constituted in an infrared-reflective coating on the lens 39, itself. This coating, which can be of the same kind as the infrared-reflective coating described above in connection with the glass substrate 43 of FIG. 4, is placed on the surface of the lens facing the reflector 15, so that the infrared light never reaches the lens itself. Most of the so-reflected infrared light eventually is absorbed by the lens tube 29.

Figure 6:
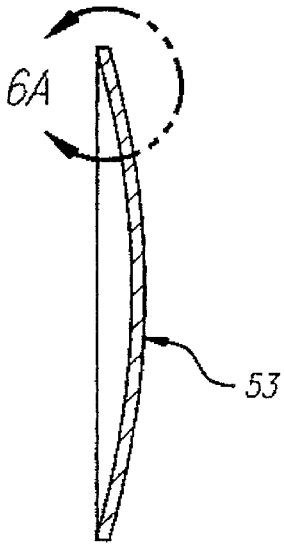

Eliminating infrared light from the projected beam by the various structures described above not only reduces undesired heat in the projected beam, but also reduces the amount of infrared light that must pass through the lens 39. Since less infrared light therefore is available to be absorbed by the lens, the lens can be formed of a suitable plastic material, thereby substantially reducing the lighting fixture's manufacturing cost. Forming the lens of a suitable plastic material also facilitates its configuration as a thin, flat fresnel lens or a thin, stepped lens, in both cases with fine grooves. A flat fresnel lens 39 is depicted in FIG. 3, with its facets oriented in a direction away from the reflector 15 and toward the glass plate 41. An example of a stepped aspheric lens, which may be substituted for the flat fresnel lens, is shown in FIG. 6. In both cases, the lenses can incorporate an aspheric surface to correct for spherical aberration, astigmatism, and field curvature in the projected beam.

The flat fresnel lens 39 is considered suitable only for lighting fixtures providing a relatively narrow beam angle, such as 5° or 10° and possibly as high as 19°. For wider beam angles, a flat fresnel lens is not considered suitable and, instead, a second curved surface is considered to be required. In lighting fixtures providing narrow beam widths, the lens has a relatively long focal length and thus is positioned relatively far from the gate assembly 31. In such lighting fixtures, the lens also must have a relatively large diameter. For these reasons, the light energy density is considered sufficiently low that the flat fresnel lens can be formed of a plastic material such as acrylic.

For lighting fixtures providing wider beam angles, the lens has a shorter focal length and thus must be positioned relatively closer to the gate assembly 31. A higher light energy density therefore must be accommodated. In this instance, the plastic material preferably is polycarbonate or other high-temperature transparent plastic material, which ordinarily exhibit a higher heat tolerance than does acrylic. In addition, because of the shorter focal length, off-axis aberrations such as coma, astigmatism, and field curvative must be corrected by the lens. A curved fresnel lens 53 or stepped aspheric lens, as shown in FIG. 6, therefore, should be used. Consequently, a stepped aspheric lens having a configuration like that shown in FIG. 6 is desired.

In all of the lighting fixture embodiments incorporating a plastic lens, and particularly those fixtures that project beams having a relatively narrow beam angle, the use of a thin plastic lens substantially reduces the fixture's weight. This enables the fixtures to maintain good balance and to be conveniently mounted in any desired orientation without the need for an elaborate support structure. The use of a thin plastic lens also allows the use of a larger-diameter lens, for a greater lens-collection efficiency. The use of a plastic lens also reduces manufacturing costs and leads to a more efficient lighting fixture.

It should be appreciated from the foregoing description that the present invention provides an improved lighting fixture for projecting a high-intensity beam of light that is imaged at a distant location, with reduced manufacturing cost, with reduced weight, and with greater efficiency. Various structures are disclosed for eliminating infrared light from the projected beam, whereby the fixture's lens can advantageously be formed of a suitable plastic material such as acrylic or polycarbonate and can be configured as an aspheric fresnel lens or a stepped aspheric lens.

Although the invention has been described in detail with reference to the presently preferred embodiments, those skilled in the art will appreciate that various modifications can be made without departing from the invention. Accordingly, the invention is defined only by the following claims.

I claim:

1. (amended) A lighting fixture for imaging a beam of light at a distant location, comprising:

a substantially ellipsoidal reflector having a base at one end and a mouth at the other end and defining a first focal region near the base and a second focal region beyond the mouth, a longitudinal axis thereby being defined;

a rear housing for supporting the reflector;

a lamp having one or more filaments that emit both visible and infrared light;

a support for supporting the lamp adjacent the base of the reflector, with the one or more filaments of the lamp located substantially coincident with the first focal region of the reflector, wherein light emitted by the one or more filaments is reflected by the reflector toward the second focal region of the reflector;

a gate aperture located substantially at the second focal region of the reflector;

a front housing having a longitudinal axis, the front housing being secured to the rear housing with the longitudinal axis of the front housing substantially aligned with the longitudinal axis of the reflector;

a lens formed of an optical-grade plastic material mounted at a selected location within the front housing, for imaging the reflected light passing through the gate aperture at a distant location; and dichroic means, interposed between the lens and the one or more filaments of the lamp, for removing from the light that reaches the lens a substantial portion of the infrared light emitted by the one or more filaments of the lamp, wherein the visible and infrared light emitted by the one or more filaments of the lamp is of sufficient intensity to overheat and damage the lens, but the dichroic means removes a sufficient portion of the infrared light to prevent such overheating and damage.

2. A lighting fixture as defined in claim 1, wherein the lens is formed of acrylic and is configured as an aspheric fresnel lens.

3. A lighting fixture as defined in claim 1, wherein the lens is formed of polycarbonate and is configured as a stepped aspheric lens.

4. A lighting fixture as defined in claim 1, wherein:

the lamp includes a glass bulb enclosing the one or more filaments; and the dichroic means includes a thin-film coating on the glass envelope of the lamp, for reflecting a substantial portion of the incident infrared light but transmitting substantially all of the incident visible light.

5. A lighting fixture as defined in claim 1, wherein the dichroic means includes:

a glass substrate located between the mouth of the reflector and the plastic lens; and a thin-film coating on the glass substrate, for reflecting a substantial portion of the incident infrared light but transmitting substantially all of the incident visible light.

6. A lighting fixture as defined in claim 5, wherein the glass substrate of the dichroic means is located at the gate aperture.

7. A lighting fixture as defined in claim 1, wherein the dichroic means includes an infrared-absorbing glass plate located between the mouth of the reflector and the plastic lens, for absorbing a substantial portion of the incident infrared light but transmitting substantially all of the incident visible light.

8. A lighting fixture as defined in claim 7, wherein the glass plate is located at the gate aperture.

9. A lighting fixture as defined in claim 1, wherein the dichroic means includes a thin-film coating on the reflector, for transmitting a substantial portion of the incident infrared light but reflecting substantially all of the incident visible light.

10. A lighting fixture as defined in claim 1, wherein:

the reflector is formed of metal; and the dichroic means includes a coating on the reflector, for reflecting substantially all of the incident visible light but absorbing a substantial portion of the incident infrared radiation.

11. A lighting fixture as defined in claim 1, wherein:

the reflector includes an inner portion adjacent its base and an outer portion adjacent its mouth, the inner and outer portions both being substantially ellipsoidal and both diverging from the longitudinal axis of the reflector in the direction of the mouth; and the dichroic means includes a thin-film coating on the inner portion of the reflector, but not the outer portion of the reflector, such that substantially less of the infrared light incident on the reflector is reflected by the inner portion than by the outer portion.

12. A lighting fixture as defined in claim 1, wherein the dichroic means includes a thin-film coating on the surface of the plastic lens facing the reflector, for reflecting a substantial portion of the incident infrared light but transmitting substantially all of the incident visible light.

13. A lighting fixture for imaging a beam of light at a distant location, comprising:

a substantially ellipsoidal reflector having a base at one end and a mouth at the other end and defining a first focal region near the base and a second focal region beyond the mouth, a longitudinal axis thereby being defined;

a rear housing for supporting the reflector;

a lamp having one or more filaments that emit both visible and infrared light;

a support for supporting the lamp adjacent the base of the reflector, with the one or more filaments of the lamp located substantially coincident with the first focal region of the reflector, wherein light emitted by the one or more filaments is reflected by the reflector toward the second focal region of the reflector;

a gate aperture located substantially at the second focal region of the reflector;

a front housing having a longitudinal axis, the front housing being secured to the rear housing with the longitudinal axis of the front housing substantially aligned with the longitudinal axis of the reflector;

a lens mounted at a selected location within the front housing, for imaging the reflected light passing through the gate aperture at a distant location;

wherein the reflector includes an inner portion adjacent its base and an outer portion adjacent its mouth, the inner and outer portions both being substantially ellipsoidal and both diverging from the longitudinal axis of the reflector in the direction of the mouth; and a dichroic coating on the inner portion of the reflector, but not the outer portion of the reflector, for removing from the light that reaches the lens a sufficient portion of the infrared light emitted by the one or more filaments of the lamp to enable the apparatus to image a beam at the distant location.

14. A lighting fixture as defined in claim 13, wherein the lens is a thin fresnel lens or stepped lens and formed of an optical grade plastic material.

15. A lighting fixture as defined in claim 13, wherein:

the inner portion of the reflector is formed of glass; and the dichroic coating on the inner portion of the reflector is a thin-film coating adapted to transmit a substantial portion of the incident infrared light but reflect substantially all of the incident visible light.

16. A lighting fixture as defined in claim 13, wherein:

the inner portion of the reflector is formed of metal; and the dichroic coating on the inner portion of the reflector is adapted to reflect substantially all of the incident visible light but absorb a substantial portion of the incident infrared radiation.

17. A lighting fixture as defined in claim 1, wherein the lens if formed of acrylic or polycarbonate.

18. A lighting fixture as defined in claim 13, wherein the lens is formed of acrylic or polycarbonate.

19. A lighting fixture for imaging a beam of light at a distant location, comprising:

a substantially ellipsoidal reflector having a base at one end and a mouth at the other end and defining a first focal region near the base and a second focal region beyond the mouth, a longitudinal axis thereby being defined;

a rear housing for supporting the reflector;

a lamp having one or more filaments that emit both visible and infrared light;

a support for supporting the lamp adjacent the base of the reflector, with the one or more filaments of the lamp located substantially coincident with the first focal region of the reflector, wherein light emitted by the one or more filaments is reflected by the reflector toward the second focal region of the reflector;

a gate aperture located substantially at the second focal region of the reflector;

a front housing having a longitudinal axis, the front housing being secured to the rear housing with the longitudinal axis of the front housing substantially aligned with the longitudinal axis of the reflector;

an acrylic or polycarbonate lens mounted at a selected location within the front housing, for imaging the reflected light passing through the gate aperture at a distant location; and dichroic means, interposed between the lens and the one or more filaments of the lamp, for removing from the light that reaches the lens a substantial portion of the infrared light emitted by the one or more filaments of the lamp, wherein the visible and infrared light emitted by the one or more filaments of the lamp is of sufficient intensity to overheat and damage the lens, but the dichroic means removes a sufficient portion of the infrared light to prevent such overheating and damage.

* * * * *